US012097402B2

(12) United States Patent
Shishtar

(10) Patent No.: US 12,097,402 B2
(45) Date of Patent: Sep. 24, 2024

(54) TABLE FOR ARMWRESTLING THAT ENABLES UPRIGHT ASSEMBLY THEREOF

(71) Applicant: Hadi Shishtar, Kansas City, KS (US)

(72) Inventor: Hadi Shishtar, Kansas City, KS (US)

( * ) Notice: Subject to any disclaimer, the term of this patent is extended or adjusted under 35 U.S.C. 154(b) by 0 days.

(21) Appl. No.: 18/595,882

(22) Filed: Mar. 5, 2024

(65) Prior Publication Data

US 2024/0198169 A1 Jun. 20, 2024

(51) Int. Cl.
*A63B 21/28* (2006.01)

(52) U.S. Cl.
CPC ..... *A63B 21/28* (2013.01)

(58) Field of Classification Search
CPC ..... A47B 3/06; A47B 13/02; A63B 23/129; A63B 21/28
See application file for complete search history.

(56) References Cited

U.S. PATENT DOCUMENTS 4,068,843 A * 1/1978 Frost ..... A63B 23/129 482/905
4,135,691 A * 1/1979 Wiesmann ..... A47B 3/0809 248/439
4,138,953 A * 2/1979 Tashman ..... A47B 57/265 248/188
4,162,068 A * 7/1979 Berg ..... A63B 21/28 273/455
5,613,927 A * 3/1997 Rothacker ..... A63B 21/28 482/44
2015/0173506 A1* 6/2015 Carter ..... A47B 19/00 248/445
2021/0016130 A1* 1/2021 Cope ..... A63B 21/4029
2021/0275871 A1* 9/2021 Rothacker ..... A63B 21/4043
2024/0041200 A1* 2/2024 Wangberg ..... A47B 91/005

OTHER PUBLICATIONS

ShinEtsu, Liquid Silicone Rubber for Silicone Leather [online], Published: Feb. 19, 2020 <URL: https://web.archive.org/web/20200219163209/https://www.Shinetsusilicone-global.com/products/notice/156/index.shtml (Year: 2020).*

Pamela, Know Your Furniture Leg Styles [online], Published: Dec. 12, 2019 <URL: https://www.thesprucecrafts.com/know-your-furniture-leg-styles-4053726?utm_campaign=shareurlbuttons _nip &utm_medium=social&utm_source=pinterest> (Year: 2019).*

* cited by examiner

*Primary Examiner* — Zachary T Moore
(74) *Attorney, Agent, or Firm* — Alexander Postnikov

(57) ABSTRACT

The conventionally available tables for armwrestling are assembled upside down with the need of two external bolts to be fastened into pegs. Also, four external bolts are needed to attach the base to the legs. This method is extremely annoying especially when an arm-wrestling team wants to move their table from one place to another. The need for flipping the table top over and positioning it on the floor can damage the leather if there is nothing placed on the floor. In contrast, the present disclosure provides an improved table for armwrestling that enables upright assembly thereof. No external bolts are needed to be attached or detached at the base. None of the upper 4 Allen bolts need to be completely out of their sockets. Once these Allen bolts are out of their path in the solid bar, table top can be easily lifted for disassembly.

14 Claims, 8 Drawing Sheets

TABLE FOR ARMWRESTLING THAT ENABLES UPRIGHT ASSEMBLY THEREOF

TECHNICAL FIELD

The disclosure relates to the technical field of sports and entertainment. More specifically, the disclosure relates to an improved table for armwrestling that enables upright assembly thereof.

BACKGROUND

Arm wrestling (also spelled as armwrestling and also interchangeably hereinafter referred to as "armwrestling" or "arm-wrestling") is a sport with two opponents who face each other with their bent elbows placed on a table and hands firmly gripped, who then attempt to force the opponent's hand down to the table top ("pin" them). The sport is often casually used to demonstrate the stronger person between two or more people.

Tables used for organized armwrestling competitions include elbow pads, which indicate the area within which a competitor's elbow must remain throughout the match, pin pads, which indicate the height an opponent's hand must reach before being considered pinned, and hand pegs, which must be gripped with the non-wrestling arm and are used for additional leverage. These tables vary slightly in their dimensions based on the governing body of the competition, but are always symmetrical with predefined distances between the elbow pads and pin pads.

Normally, the conventional and worldwide accepted armwrestling table, as shown in FIG. 1 can have many parts, including:

Table top (102): A board covered with a soft rubber and abrasion resistant artificial leather. The table top should be 36 inches long and 26 inches wide. For sit-down competition, the tabletop should be 28 inches from the floor. For stand-up matches, the table top should be 40 inches from the floor. The peg should be 2.5 cm (1 inch) in diameter and 15.2 cm (6 inches) high from the tabletop.

Side pads (104): Two side pads, Elbow pads (106): Two elbow pads, Grips (108): Steel grips plated with nickel, Frame: Made of steel, Legs (110): Four legs with a minimum of 28 inches inside leg and a minimum of 18 inches leg to leg, other parts: Chalk stand, staging, riser platforms, and straps.

The World Armwrestling Federation (WAF) has the following specifications for arm wrestling tables:

Sit down: 28 inches from the floor to the top of the table
Stand up: 40 inches from the floor to the top of the table
Tabletop: 91.4 centimeters
Seats: 18 inches square and 18 inches from the floor to the seat top
Material: Square tubing is best, but tubular steel, flat iron, or angle iron can also be used.

The assembly of the current professional arm-wrestling tables is done upside down with the need of two external bolts to be fastened into pegs. In addition, four external bolts are needed to attach the base to the legs. This method is extremely time consuming, not to mention annoying, especially when an arm-wrestling team wants to move their table from one place to another. Further, the need for flipping the table top over and positioning it on the floor can damage the leather if there is nothing placed on the floor prior to installation.

SUMMARY

The disclosure relates to the technical field of sports and entertainment. More specifically, the disclosure relates to an improved table for armwrestling that enables upright assembly thereof.

As it be noted from the above, the conventionally available tables for armwrestling are assembled upside down with the need of two external bolts to be fastened into pegs. Also, four external bolts are needed to attach the base to the legs. This method is extremely annoying especially when an arm-wrestling team wants to move their table from one place to another. The need for flipping the table top over and positioning it on the floor can damage the leather if there is nothing placed on the floor (for example: a mat, carpet, etc.) prior to installation. Additionally, it is a time-consuming process.

In contrast, the present disclosure provides an improved table for armwrestling that enables upright assembly thereof. No external bolts are needed to be attached or detached at the base. None of the upper 4 Allen bolts need to be completely out of their sockets. Once these Allen bolts are out of their path in the solid bar, table top can be easily lifted for disassembly.

BRIEF DESCRIPTION OF DRAWINGS

The accompanying drawings are included to provide a further understanding of the present disclosure and are incorporated in and constitute a part of this specification. The drawings illustrate exemplary embodiments of the present disclosure and, together with the description, serve to explain the principles of the present disclosure.

The diagrams are for illustration only, which thus is not a limitation of the present disclosure, and wherein.

DETAILED DESCRIPTION OF DRAWINGS

Figure 1:
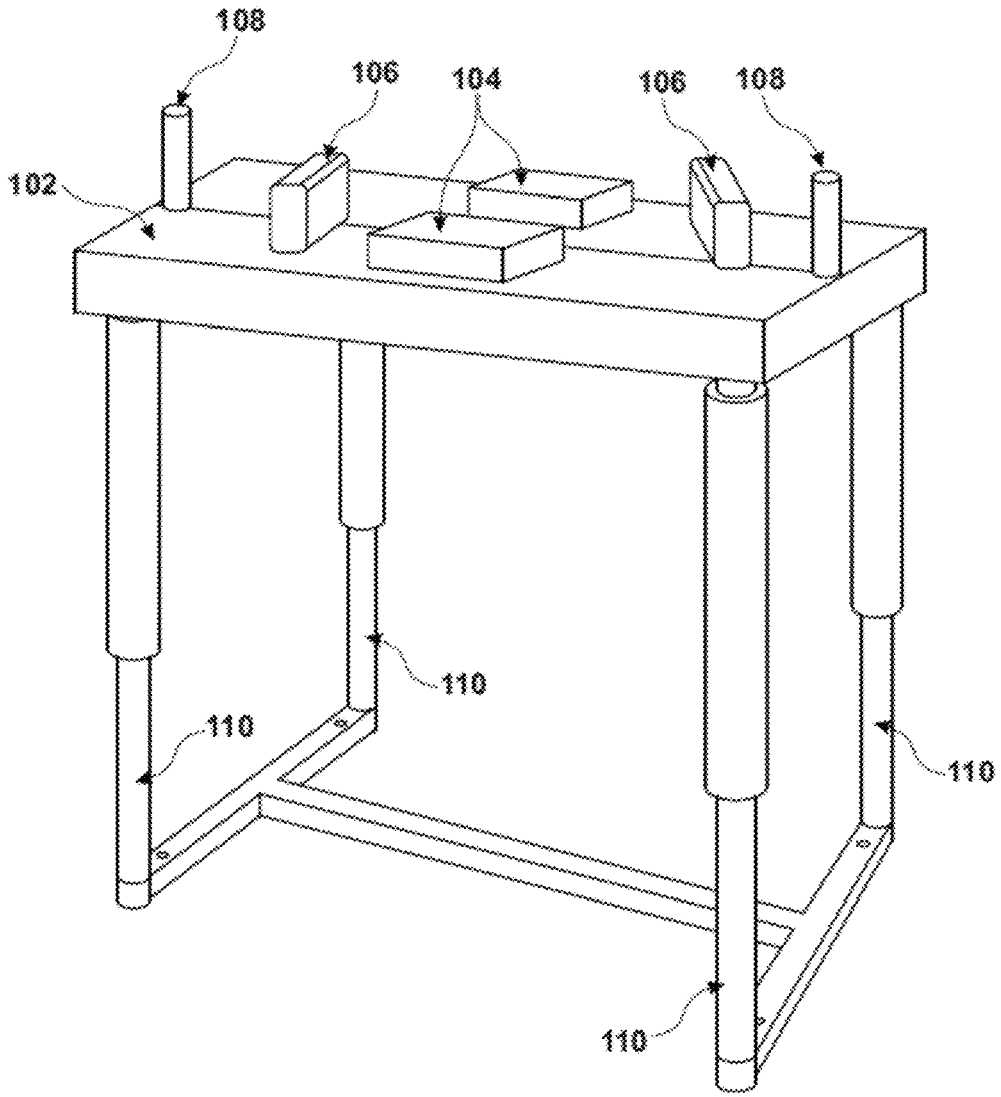
FIG. 1 (PRIOR ART)
FIG. 1 illustrates an exemplary conventional and worldwide accepted armwrestling table, available in the prior-art.

The following detailed description is made with reference to the technology disclosed. Preferred implementations are described to illustrate the technology disclosed, not to limit its scope, which is defined by the claims. Those of ordinary skill in the art will recognize a variety of equivalent variations on the description.

Examples of systems, apparatus, computer-readable storage media, and methods according to the disclosed implementations are described in this section. These examples are being provided solely to add context and aid in the understanding of the disclosed implementations. It will thus be apparent to one skilled in the art that the disclosed implementations may be practiced without some or all of the specific details provided. In other instances, certain process or method operations, also referred to herein as "blocks," have not been described in detail in order to avoid unnecessarily obscuring the disclosed implementations. Other implementations and applications also are possible, and as such, the following examples should not be taken as definitive or limiting either in scope or setting.

In the following detailed description, references are made to the accompanying drawings, which form a part of the description and in which are shown, by way of illustration, specific implementations. Although these disclosed implementations are described in sufficient detail to enable one skilled in the art to practice the implementations, it is to be understood that these examples are not limiting, such that other implementations may be used and changes may be made to the disclosed implementations without departing from their spirit and scope. For example, the blocks of the methods shown and described herein are not necessarily performed in the order indicated in some other implementations. Additionally, in some other implementations, the disclosed methods may include more or fewer blocks than are described. As another example, some blocks described herein as separate blocks may be combined in some other implementations. Conversely, what may be described herein as a single block may be implemented in multiple blocks in some other implementations. Additionally, the conjunction "or" is intended herein in the inclusive sense where appropriate unless otherwise indicated; that is, the phrase "A, B or C" is intended to include the possibilities of "A," "B," "C," "A and B," "B and C," "A and C" and "A, B and C."

Some implementations described and referenced herein are directed to systems, apparatus, computer-implemented methods and computer-readable storage media for detecting flooding of message queues.

Thus, for example, it will be appreciated by those of ordinary skill in the art that the diagrams, schematics, illustrations, and the like represent conceptual views or processes illustrating systems and methods embodying this disclosure. The functions of the various elements shown in the figures may be provided through the use of dedicated hardware as well as hardware capable of executing associated software. Similarly, any electronic code generator shown in the figures are conceptual only. Their function may be carried out through the operation of program logic, through dedicated logic, through the interaction of program control and dedicated logic, or even manually, the particular technique being selectable by the entity implementing this disclosure. Those of ordinary skill in the art further understand that the exemplary hardware, software, processes, methods, and/or operating systems described herein are for illustrative purposes and, thus, are not intended to be limited to any particular named.

Various terms as used herein are shown below. To the extent a term used in a claim is not defined below, it should be given the broadest definition persons in the pertinent art have given that term as reflected in printed publications and issued patents at the time of filing.

Although the present disclosure has been described with the purpose of implementing an improved table for armwrestling that enables upright assembly thereof, it should be appreciated that the same has been done merely to illustrate the invention in an exemplary manner and any other purpose or function for which the explained structure or configuration can be used, is covered within the scope of the present disclosure.

The conventionally available tables for armwrestling are assembled upside down with the need of two external bolts to be fastened into pegs. Also, four external bolts are needed to attach the base to the legs. This method is extremely annoying especially when an arm-wrestling team wants to move their table from one place to another. The need for flipping the table top over and positioning it on the floor can damage the leather if there is nothing placed on the floor (for example: a mat, carpet, etc.) prior to installation. Additionally, it is a time-consuming process.

In contrast, the present disclosure provides an improved table for armwrestling that enables upright assembly thereof. No external bolts are needed to be attached or detached at the base. None of the upper 4 Allen bolts need to be completely out of their sockets. Once these Allen bolts are out of their path in the solid bar, table top can be easily lifted for disassembly.

Figure 2:
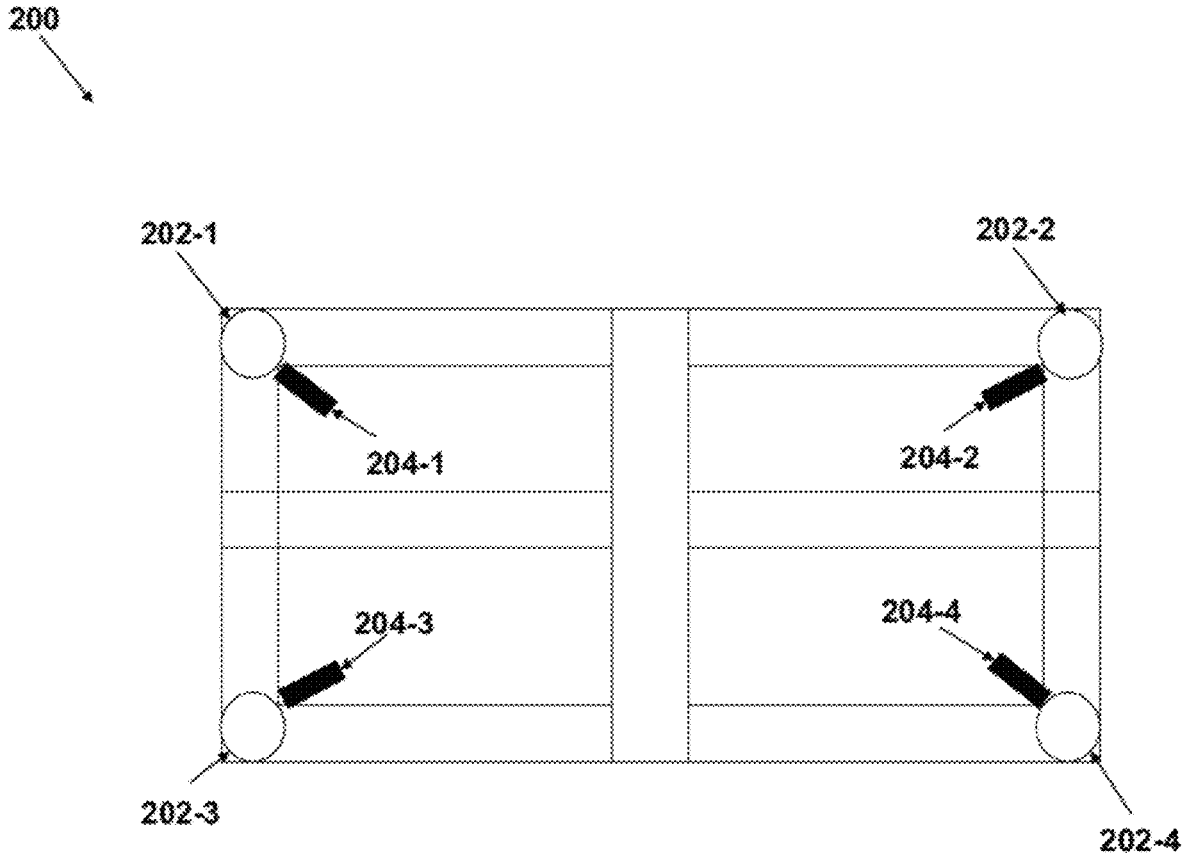
FIG. 2 illustrates a rectangular frame of the armwrestling table installable in an upright manner, in accordance with an embodiment of the present invention.

FIG. 2 illustrates a rectangular frame of the armwrestling table installable in an upright manner, in accordance with an embodiment of the present invention.

Figure 3:
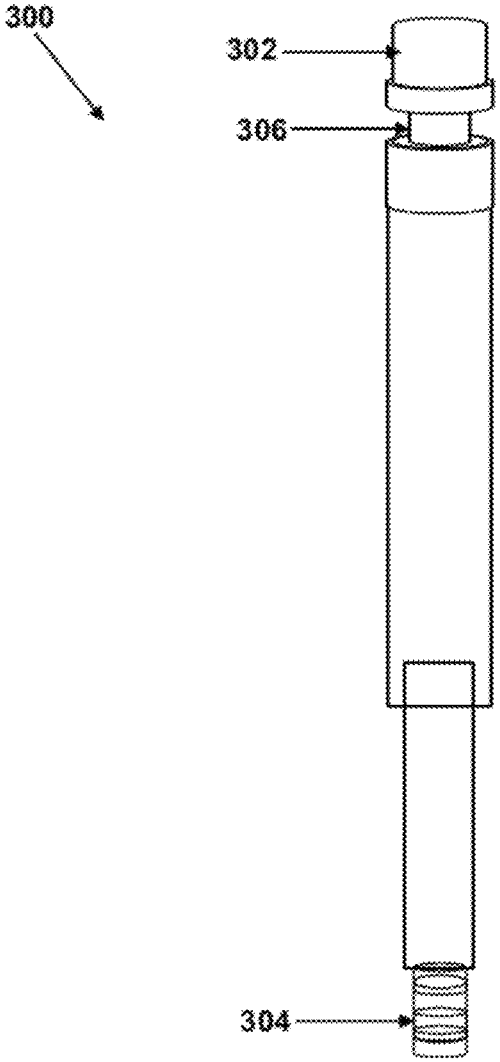
FIG. 3 illustrates a leg of the armwrestling table installable in an upright manner, in accordance with an embodiment of the present invention.

FIG. 3 illustrates a leg of the armwrestling table installable in an upright manner, in accordance with an embodiment of the present invention.

Figure 4:
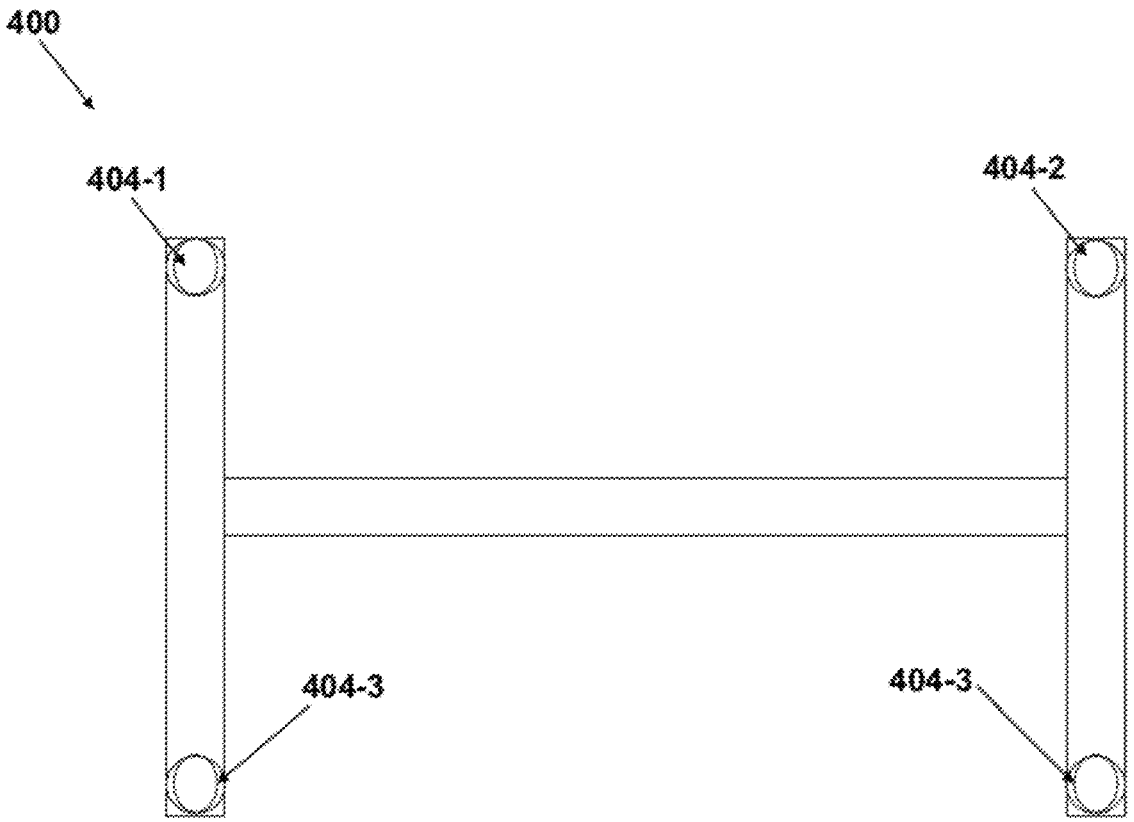
FIG. 4 illustrates a base frame of the armwrestling table installable in an upright manner, in accordance with an embodiment of the present invention.

FIG. 4 illustrates a base frame of the armwrestling table installable in an upright manner, in accordance with an embodiment of the present invention.

In an embodiment an armwrestling table installable in an upright manner is disclosed. As shown in FIGS. 2 and 3, the armwrestling table includes a table top having a substantially rectangular frame (200) covered with a first material. The substantially rectangular frame (200) comprises at least four circular holes (202-1, 202-2, 202-3, 202-4) such that each of the at least four circular holes (202-1, 202-2, 202-3, 202-4) are adapted to receive at least one bead portion (302) of at least one leg (300) to stabilize the table top and holds the table top above a floor.

In an exemplary implementation, the steel top which is made of 4 female threaded solid bars, rectangular beams and 4 Allen bolts. Four holes are made at the corners of the rectangular beams to allow each leg top to slide into them.

In an exemplary embodiment, the first material includes a combination of soft rubber and abrasion resistant artificial leather.

In an exemplary embodiment, the at least one leg (300) is a fluted table leg having the at least one bead portion (302) (flute) running vertically on a column shaft or a pilaster.

In an exemplary embodiment, the at least one leg (300) is a Marlborough table leg having the at least one bead (302) running vertically on a column shaft or a pilaster.

In an exemplary embodiment, as shown in FIG. 3, the at least one bead portion (302) is a convex arc structure that protrudes from the at least one leg (300).

In an exemplary embodiment, as shown in FIG. 3, the at least one bead portion (302) is a bulging structure that protrudes from the at least one leg (300).

In an exemplary embodiment, as shown in FIG. 3, the at least one leg (300) is a column shaft or a pilaster having the at least one bead portion (302) at a first end, and wherein the first end is inserted in the at least one hole of the at least four circular holes.

In an exemplary implementation, the leg (300) may be a cylindrical leg which are made of steel pipes with specially designed solid bars welded to the top and bottom of the legs. In addition, rubber hoses are placed on the pipes to minimize the risk of knee sliding in arm wrestling matches.

The leg (300) includes a solid bar is inserted into the top of each leg and then welded to it. This solid bar is designed using lathe machine in a way that will be seen in the upcoming images.

Another male 16 mm (m16) threaded solid bar can be inserted into the bottom of each leg and then welded to it.

Rubber hoses with a hole diameter that is 1 mm or 1.5 mm smaller than the outer diameter of the legs. The rubber is inserted into the pipes using pressure by lathe machine. The diameter difference makes rubber impossible to slide while in use during an arm-wrestling match.

A (V) is made to the top and bottom of the pipes and solid bars to let weld fill into them and then cleaned with lathe machine, as seen in the image herein.

In another exemplary embodiment, as shown in FIGS. 2 and 3, the at least one leg (300) comprises a second end having a threaded portion (304) that is adapted to be inserted in at least one of at least four holes (402-1, 402-2, 402-3, 402-4) provided on a base frame (400) of the armwrestling table, wherein the base frame is close to the floor.

In another exemplary embodiment, as shown in FIG. 4, the base frame (400) includes at least four females threaded (M16 or 16 mm) solid bars and one or more square beams welded to the threaded bars. In an exemplary implementation, the solid bars are square beams are lifted 10 mm from the floor to minimize damage and cracks on the paint. Further, holes are made at 65 mm from the centre of the threads. These holes are used to bolt the table to a platform in professional arm-wrestling matches.

In another exemplary embodiment, as shown in FIG. 4, the base frame (400) is fixed on the floor or the base frame is elevated from the floor.

In an exemplary embodiment, as shown in FIG. 3, the at least one leg (300) having the at least one bead portion (302) comprises a cove region (concave groove cut) immediately below the at least one bead portion fabricated such that the cove region remains outside when the at least one bead portion is inserted in the at least one hole of the at least four circular holes.

In an exemplary embodiment, as shown in FIGS. 2 and 3, the substantially rectangular frame (200) comprises at least one solid bar (204-1, 204-2, 204-3, 204-4) in proximity to each of the at least four circular holes (202-1, 202-2, 202-3, 202-4). The at least one leg (300) comprises a cove region (306) (concave groove cut) immediately below the at least one bead portion (302) fabricated such that the cove region (306) remains outside when the at least one bead portion (302) is inserted in the at least one hole of the at least four circular holes. The at least one solid bar (204-1, 204-2, 204-3, 204-4) is adapted to engage with the cove region so as to rigidly hold the at least one leg making at least 90-degree angle to the substantially rectangular frame to stabilize the table top.

In an exemplary embodiment, the solid bar is a hook.

In an exemplary embodiment, the solid bar is an allen bolt. made of stainless steel, aluminium, and iron.

In another embodiment, another armwrestling table installable in an upright manner is disclosed. The armwrestling table includes a table top having a substantially rectangular frame covered with a first material. The substantially rectangular frame comprises at least four circular holes such that each of the at least four circular holes are adapted to receive at least one bead portion of at least one leg to stabilize the table top and holds the table top above a floor.

The at least one leg having the at least one bead portion comprises a cove region (concave groove cut) immediately below the at least one bead portion fabricated such that the cove region remains outside when the at least one bead portion is inserted in the at least one hole of the at least four circular holes.

The at least one leg comprises a second end having a threaded portion that is adapted to be inserted in at least one hole provided on a base frame of the armwrestling table, wherein the base frame is close to the floor.

Figure 5A:
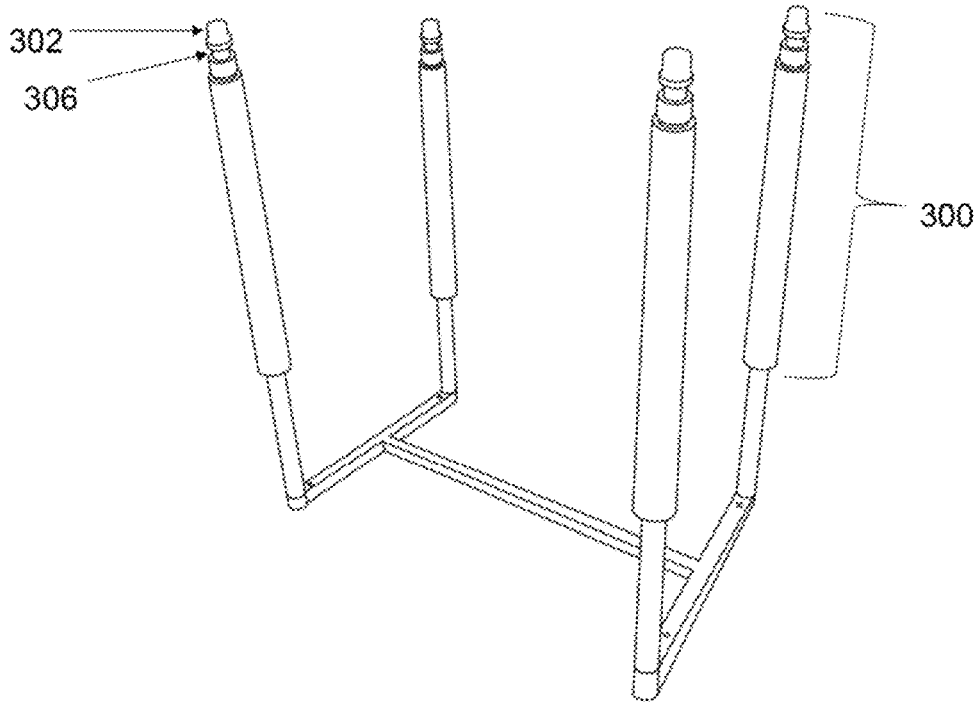
FIGS. 5A-5C illustrates an exemplary installation process of the armwrestling table installable in an upright manner, in accordance with an embodiment of the present invention.
Figure 5B:
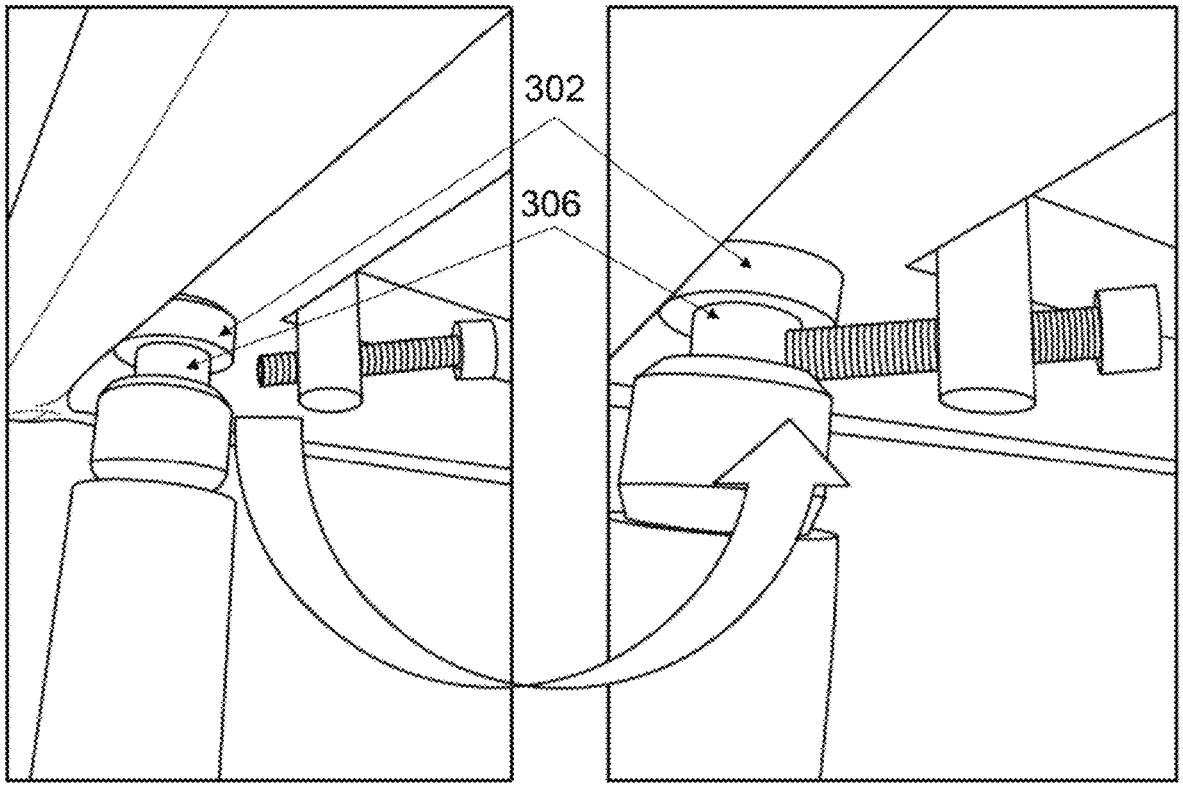
Figure 5C:
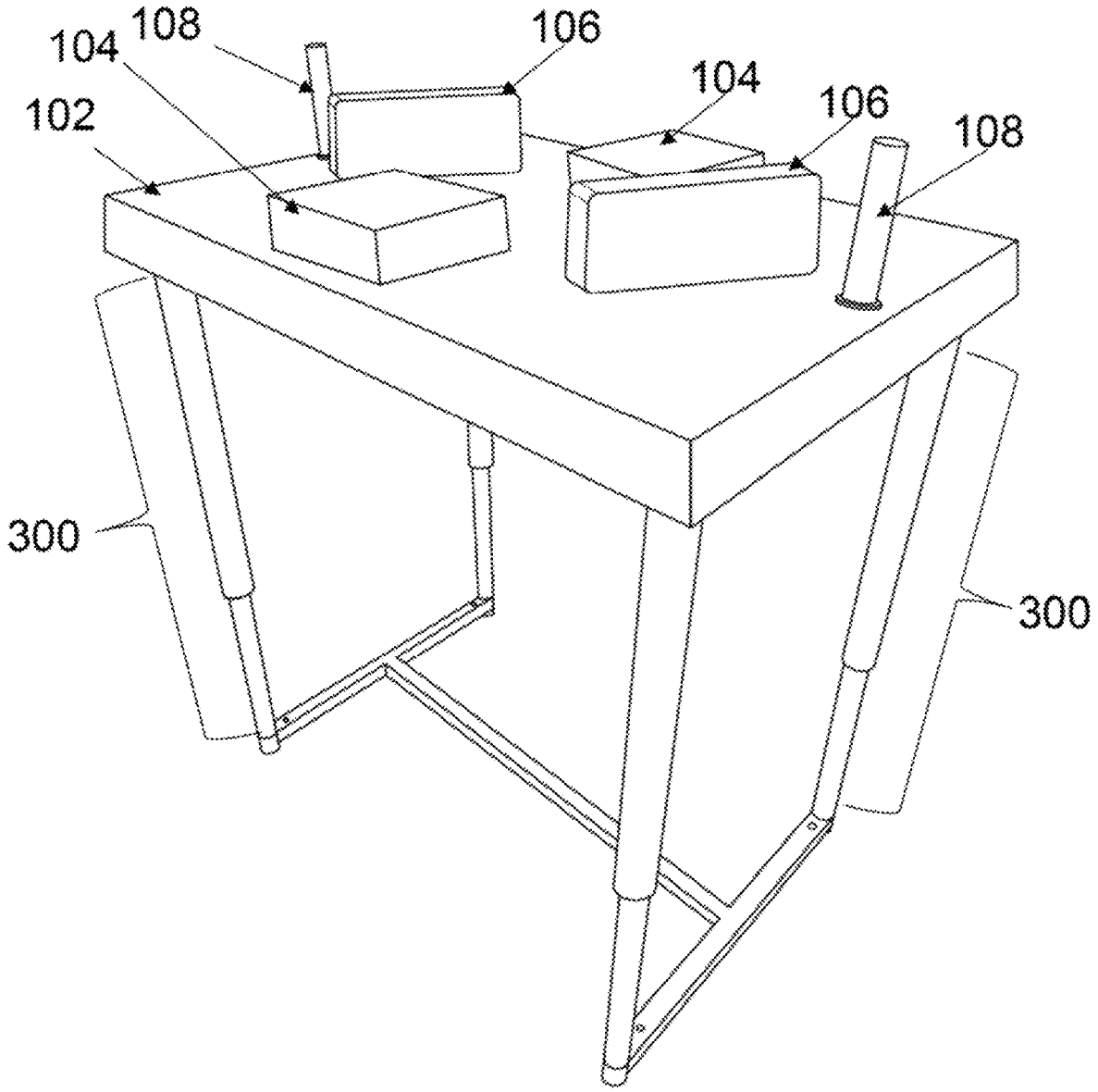

The substantially rectangular frame further comprises at least one solid bar in proximity to each of the at least four circular holes, the solid bar is adapted to engage with the cove region so as to rigidly hold the at least one leg making at least 90-degree angle to the substantially rectangular frame to stabilize the table top FIGS. 5A-5C illustrates an exemplary installation process of the armwrestling table installable in an upright manner, in accordance with an embodiment of the present invention.

As shown in the FIGS. 5A-5C, once the legs are inserted in their respective holes of the frame and the holes provided on the base frames, the solid bar provided near the holes are tightened in the cove region so as to fix the leg to a spot required.

FIG. 5C shows the completely installed table ready for armwrestling.

Figure 6:
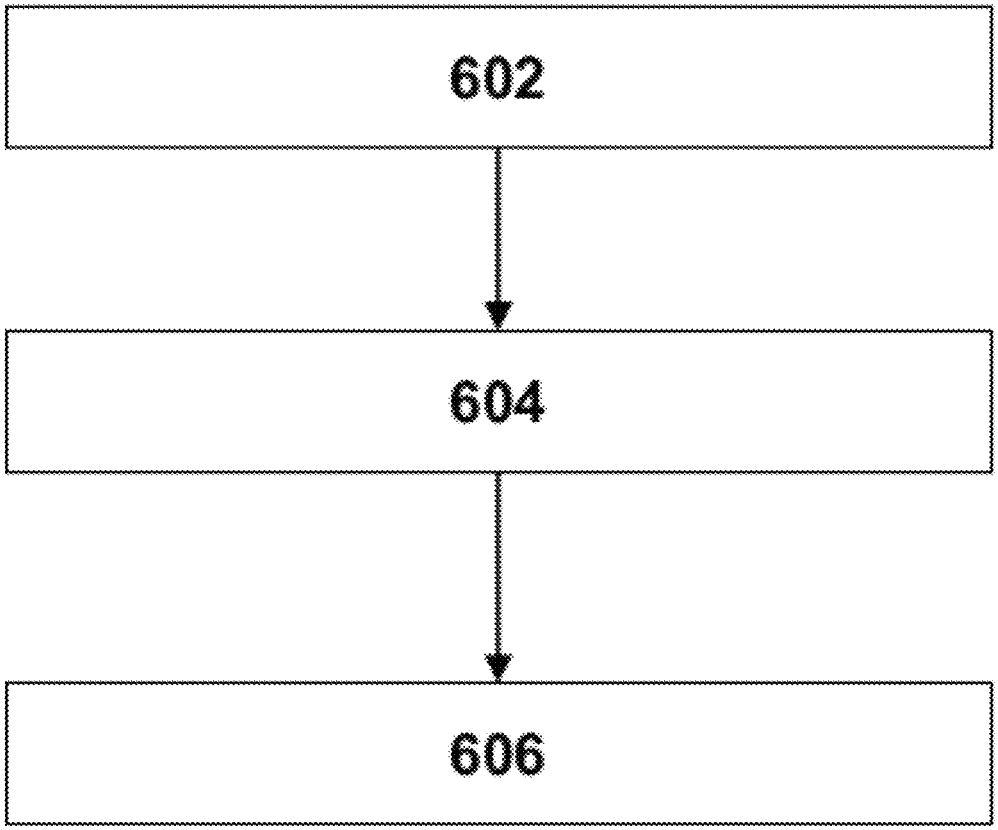
FIG. 6 illustrates a flowchart showing a method of installation of an armwrestling table in an upright manner, in accordance with an embodiment of the present invention.

FIG. 6 illustrates a flowchart showing a method of installation of an armwrestling table in an upright manner, in accordance with an embodiment of the present invention.

The conventionally available tables for armwrestling are assembled upside down with the need of two external bolts to be fastened into pegs. Also, four external bolts are needed to attach the base to the legs. This method is extremely annoying especially when an arm-wrestling team wants to move their table from one place to another. The need for flipping the table top over and positioning it on the floor can damage the leather if there is nothing placed on the floor (for example: a mat, carpet, etc.) prior to installation. Additionally, it is a time-consuming process.

In contrast, the present disclosure provides an improved table for armwrestling that enables upright assembly thereof. No external bolts are needed to be attached or detached at the base. None of the upper 4 Allen bolts need to be completely out of their sockets. Once these Allen bolts are out of their path in the solid bar, table top can be easily lifted for disassembly.

At step 602, a threaded portion of a second end of at least one leg is inserted into at least one hole provided on a base frame of the armwrestling table. The at least one leg comprises a first end having at least one bead portion.

At step 604, a table top having a substantially rectangular frame is placed over the at least one leg having the threaded portion of the second end of the at least one leg while inserted into the base frame. The substantially rectangular frame comprises at least four circular hole.

At step 606, at least one at least one bead portion of the first end of the at least one leg is then slided into at least one circular hole of the at least four circular holes to stabilize the table top and holds the table top above a floor.

In this embodiment, the substantially rectangular frame comprises at least one solid bar in proximity to each of the at least four circular holes. The at least one leg comprises a cove region (concave groove cut) immediately below the at least one bead portion fabricated such that the cove region remains outside when the at least one bead portion is inserted in the at least one hole of the at least four circular holes.

The at least one solid bar is adapted to engage with the cove region so as to rigidly hold the at least one leg making at least 90-degree angle to the substantially rectangular frame to stabilize the table top.

While some embodiments of the present disclosure have been illustrated and described, those are completely exemplary in nature. The disclosure is not limited to the embodiments as elaborated herein only and it would be apparent to those skilled in the art that numerous modifications besides those already described are possible without departing from the inventive concepts herein. All such modifications, changes, variations, substitutions, and equivalents are completely within the scope of the present disclosure. The inventive subject matter, therefore, is not to be restricted except in the protection scope of the appended claims.

What is claimed is:

1. An armwrestling table installable in an upright manner, the armwrestling table comprising:

a table top having a substantially rectangular frame covered with a first material, wherein the substantially rectangular frame comprises at least four circular holes such that each of the at least four circular holes is adapted to receive at least one bead portion of at least one leg to stabilize the table top and holds the table top above a floor, wherein the at least one leg having the at least one bead portion comprises a cove region in the form of a concave groove cut immediately below the at least one bead portion fabricated such that the cove region remains outside when the at least one bead portion is inserted in the at least one hole of the at least four circular holes.

2. The armwrestling table of claim 1, wherein the first material includes a combination of soft rubber and abrasion resistant artificial leather.

3. The armwrestling table of claim 1, wherein the at least one leg is a fluted table leg having the at least one bead portion in the form of a flute running vertically on a column shaft or a pilaster.

4. The armwrestling table of claim 1, wherein the at least one leg is a Marlborough table leg having the at least one bead running vertically on a column shaft or a pilaster.

5. The armwrestling table of claim 1, wherein the at least one bead portion is a convex arc structure that protrudes from the at least one leg.

6. The armwrestling table of claim 1, wherein the at least one bead portion is a bulging structure that protrudes from the at least one leg.

7. The armwrestling table of claim 1, wherein the at least one leg is a column shaft or a pilaster having the at least one bead portion at a first end, and wherein the first end is inserted in the at least one hole of the at least four circular holes.

8. The armwrestling table of claim 7, wherein the at least one leg comprises a second end having a threaded portion that is adapted to be inserted in at least one of at least four holes provided on a base frame of the armwrestling table, wherein the base frame is close to the floor.

9. The armwrestling table of claim 8, wherein the base frame includes at least four female threaded solid bars and one or more square beams welded to the threaded bars.

10. The armwrestling table of claim 8, wherein the base frame is fixed on the floor or the base frame is elevated from the floor.

11. The armwrestling table of claim 1, wherein:

the substantially rectangular frame comprises at least one solid bar in proximity to each of the at least four circular holes;

wherein the at least one solid bar is adapted to engage with the cove region so as to rigidly hold the at least one leg making at least 90-degree angle to the substantially rectangular frame to stabilize the table top.

12. The armwrestling table of claim 11, wherein the solid bar is engaged with an Allen bolt made of stainless steel, aluminium, or iron.

13. A method of installation of an armwrestling table in an upright manner, the method comprising:

inserting a threaded portion of a second end of at least one leg into at least one female thread provided on a base frame of the armwrestling table, and wherein the at least one leg comprises a first end having at least one bead portion;

placing a table top having a substantially rectangular frame over the at least one leg having the threaded portion of the second end of the at least one leg while inserted into the base frame, wherein the substantially rectangular frame comprises at least four circular holes;

sliding at least one bead portion of the first end of the at least one leg into at least one circular hole of the at least four circular holes to stabilize the table top and holds the table top above a floor; and the substantially rectangular frame comprises at least one solid bar in proximity to each of the at least four circular holes; and the at least one leg comprises a cove region in the form of a concave groove cut immediately below the at least one bead portion fabricated such that the cove region remains outside when the at least one bead portion is inserted in the at least one hole of the at least four circular holes; and wherein the at least one solid bar is adapted to engage with the cove region so as to rigidly hold the at least one leg making at least 90-degree angle to the substantially rectangular frame to stabilize the table top.

14. An armwrestling table installable in an upright manner, the armwrestling table comprising:

a table top having a substantially rectangular frame covered with a first material, wherein the substantially rectangular frame comprises:

at least four circular holes such that each of the at least four circular holes is adapted to receive at least one bead portion of at least one leg to stabilize the table top and holds the table top above a floor;

wherein the at least one leg having the at least one bead portion comprises a cove region in the form of a concave groove cut immediately below the at least one bead portion fabricated such that the cove region remains outside when the at least one bead portion is inserted in the at least one hole of the at least four circular holes;

the at least one leg comprises a second end having a threaded portion that is adapted to be inserted in at least one female thread provided on a base frame of the armwrestling table, wherein the base frame is close to the floor;

wherein the substantially rectangular frame further comprises at least one solid bar in proximity to each of the at least four circular holes, the solid bar is adapted to engage with the cove region so as to rigidly hold the at least one leg making at least 90-degree angle to the substantially rectangular frame to stabilize the table top.

* * * * *